US007637596B2

(12) United States Patent
Nawa

(10) Patent No.: US 7,637,596 B2
(45) Date of Patent: Dec. 29, 2009

(54) PRINT HEAD WITH LIQUID CHANNELS HAVING MOVABLE VALVES

(75) Inventor: Satoshi Nawa, Kanagawa (JP)

(73) Assignee: Canon Finetech Inc., Misato-shi (JP)

( * ) Notice: Subject to any disclaimer, the term of this patent is extended or adjusted under 35 U.S.C. 154(b) by 498 days.

(21) Appl. No.: 11/515,749

(22) Filed: Sep. 6, 2006

(65) Prior Publication Data

US 2007/0052762 A1 Mar. 8, 2007

(30) Foreign Application Priority Data

Sep. 7, 2005 (JP) ..... 2005-259717

(51) Int. Cl.
*B41J 2/05* (2006.01)

(52) U.S. Cl. ..... 347/56; 347/65

(58) Field of Classification Search ..... 347/20, 347/44, 47, 56–59, 61–65, 67

See application file for complete search history.

(56) References Cited

U.S. PATENT DOCUMENTS 5,278,585 A * 1/1994 Karz et al. ..... 347/65
6,273,556 B1 * 8/2001 Ishinaga et al. ..... 347/65

* cited by examiner

*Primary Examiner*—Juanita D Stephens
(74) *Attorney, Agent, or Firm*—Fitzpatrick, Cella, Harper & Scinto

(57) ABSTRACT

In the prior art, ejection openings are formed of different materials having respective wettability levels Thus, ink may disadvantageously be drawn toward a more wettable material and ejected obliquely. Further, if ejection is carried out with a horizontally dripping liquid adhering to ejection opening edges and an edge of a roof plate forming a part of each ejection opening, the ink droplets may disadvantageously be ejected obliquely to the direction in which they are originally ejected. According to the present invention, the ejection openings are formed of the same material to prevent the ejecting direction from being affected by the difference in wettability. Further, a resin is raised from the ejection opening portion to prevent the horizontally dripping liquid adhering to an ejection opening periphery from contacting ejected ink droplets during ejection. As a result, the ejected ink droplets are not affected by the horizontally dripping liquid during ejection.

3 Claims, 18 Drawing Sheets

PRINT HEAD WITH LIQUID CHANNELS HAVING MOVABLE VALVES

BACKGROUND OF THE INVENTION

1. Field of the Invention

The present invention relates to a print head composed of a liquid ejecting head that ejects desired droplets utilizing bubbles generated by applying thermal energy to a liquid.

2. Description of the Related Art

Some printing apparatuses function as a printer, a copier, a facsimile, or the like, and some printing apparatuses are used as output instruments for composite electric instruments or workstations including computers and word processors. Among these printing apparatuses, ink jet printing apparatuses have been prevailing which carry out printing by ejecting ink to print media such as paper, clothes, plastic sheets, or OHP sheets on the basis of print information.

In particular, industrial ink jet printing apparatuses use a variety of print media, and various demands are being made for the material of the print media. In recent years, much effort has been made to meet these demands. Printing apparatuses have also been used which use clothes, leathers, non-woven fabrics, or metal as print media, in place of normal print media such as paper or thin resin sheets. The ink jet printing apparatus makes reduced noise, requires reduced running costs, and can be easily configured for color printing. Consequently, the ink jet printing apparatus is now widely applied to printers, copiers, facsimile machines, and the like.

Known ink jet print heads used for ink jet printing apparatuses use various schemes to form ejecting ink droplets. In particular, an ink jet print head utilizing heat as energy to eject ink can be provided with a high-density multinozzle to achieve high-resolution, high-quality, and fast printing.

With this scheme, print elements are provided in ink channels that are in communication with the respective ink ejection opening in the ink jet print head. Electric energy or power corresponding to a print signal is selectively applied to these print elements. Thermal energy generated by the application of electric energy is used to rapidly heat ink on a heat acting surface to cause film boiling. The pressure of bubbles resulting from the film boiling ejects ink from the ink ejection openings.

FIG. 17 is a perspective view schematically showing the configuration of a conventional ink jet print head. A known method for manufacturing this liquid ejecting head, for example, forms fine grooves 1202 in a plate 1203 such as glass or metal by machining means such as cutting or etching and then joins the plate 1203 in which the grooves 1202 have been formed to a roof plate 1201 to form liquid channels. Ejection openings in the head may be formed by attaching a plate called an orifice plate in which the ejection openings are formed.

SUMMARY OF THE INVENTION

In the ink jet print head manufactured by the above method, the plate 1203 and roof plate 1201 form not only the liquid channels but also ejection openings 1204 that are in communication with the liquid channels.

The plate 1203 and roof plate 1201 are manufactured as separate members and may thus be composed of different materials. In this case, the different materials have respective wettability levels, and the more wettable material wets earlier during ejection. Ink is thus drawn toward the more wettable material. Consequently, the ink is not ejected perpendicularly to an ejection opening surface but in the direction in which the ink is drawn, that is, obliquely to the ejection opening surface. As a result, ink droplets do not impact print media at the desired positions, resulting in reduced print grade.

The ejection openings 1204 in FIG. 17 are formed of planes composed of end surfaces 1206 and 1207 of the plate 1203 and roof plate 1201, respectively. Ejected ink spreads, as a horizontally dripping liquid, at ejection openings edges 1205 between the end surfaces 1206 and 1207 and at an edge 1208 of the roof plate 1201 forming a part of each ejection opening. Thus, the horizontally dripping liquid may remain at the ejection edge 1205 and at the edge 1208 of the roof plate 1201, forming a part of each ejection opening.

If ejection is carried out with the horizontally dripping liquid remaining at the ejection edge 1205 and at the edge 1208 of the roof plate 1201, forming a part of each ejection opening, ink droplets are drawn toward the adhering horizontally dripping liquid during ejection. The drawn ink droplets are ejected obliquely to the direction in which the ink droplets are originally ejected.

This makes the ink ejecting direction unstable to prevent ink droplets from impacting print media at the desired positions. The print grade is thus disadvantageously lowered.

The present invention is made in view of these problems. An object of the present invention is to provide a liquid ejecting head that can eject a liquid perpendicularly to an ejection opening surface.

According to the print head of the present invention, the periphery of the ejection openings is composed of the same material and is not affected by the difference in wettability between the constituents during ejection. The resin member constituting the ejection openings is raised from that end surface of the plate holding the resin member which has the ejection openings. This prevents the horizontally dripping liquid from contacting ink droplets during ejection. The ink droplets can be ejected perpendicularly to the ejection opening surface.

Further, the peripheries of the ejection openings are formed of the resin member. This hinders cracks or the like from occurring during cutting or polishing.

Moreover, according to the ink jet print head of the present invention, the raised resin portion serves as an orifice plate forming the ejection openings. This eliminates the need for the orifice plate, reducing costs.

The above and other objects, effects, features and advantages of the present invention will become more apparent from the following description of embodiments thereof taken in conjunction with the accompanying drawings.

DETAILED DESCRIPTION OF PREFERRED EMBODIMENTS

An embodiment of the present invention will be described below in detail with reference to the drawings.

Figure 1:
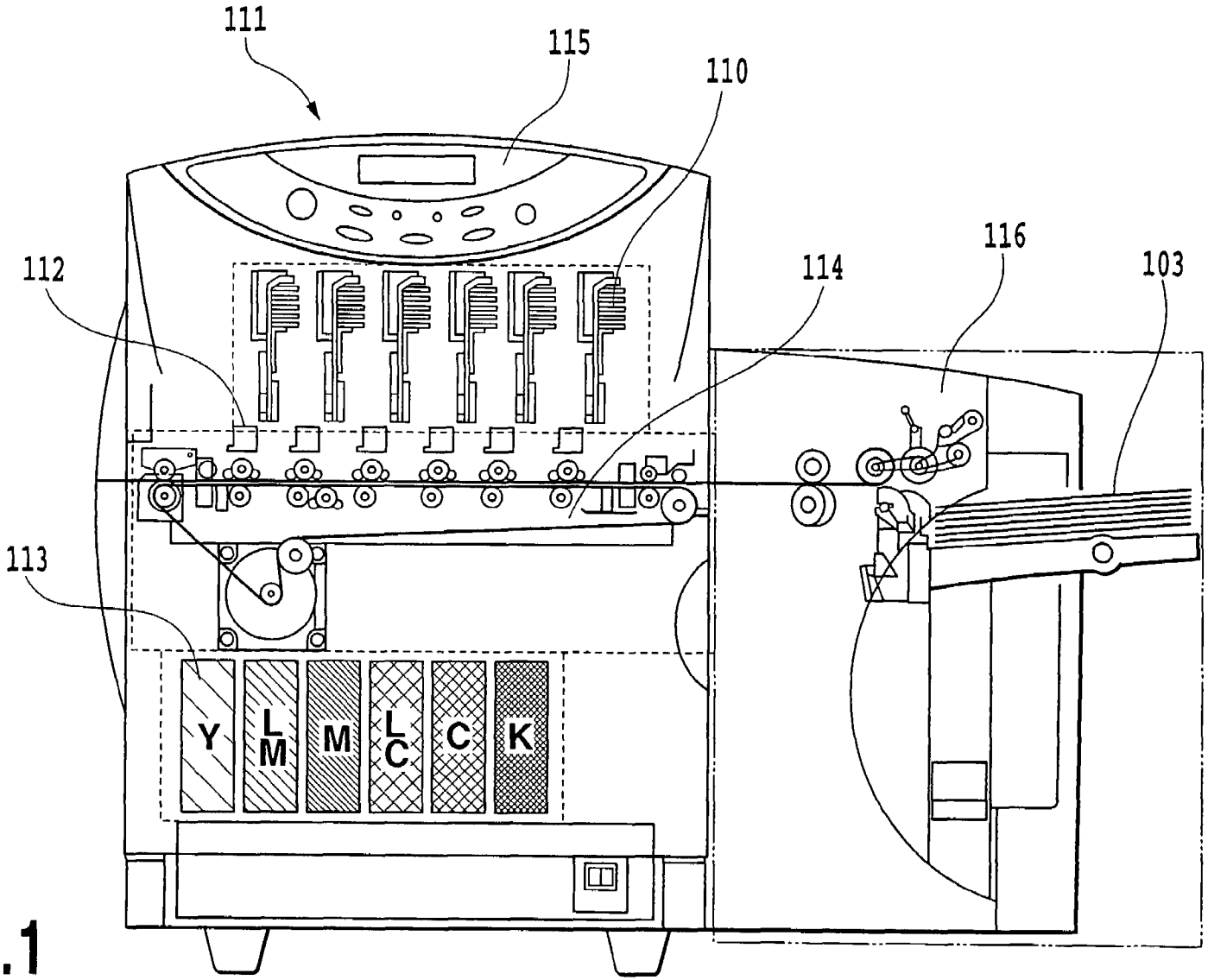
FIG. 1 is a front view showing the internal structure of an ink ejecting device comprising a liquid ejecting head 110 according to an embodiment of the present invention.

FIG. 1 is a plan view showing the internal structure of a printing apparatus 111 comprising a print head 110 according to an embodiment of the present invention.

In FIG. 1, the printing apparatus 111 is composed of a plurality of print heads 110, recovery units 112 provided in the respective print heads 110, cartridges 113 that house ink, a conveying section 114, an operation panel section 115, a sheet feeding section 116 that feeds sheets 103 to the printing apparatus main body, and the like.

Figure 2:
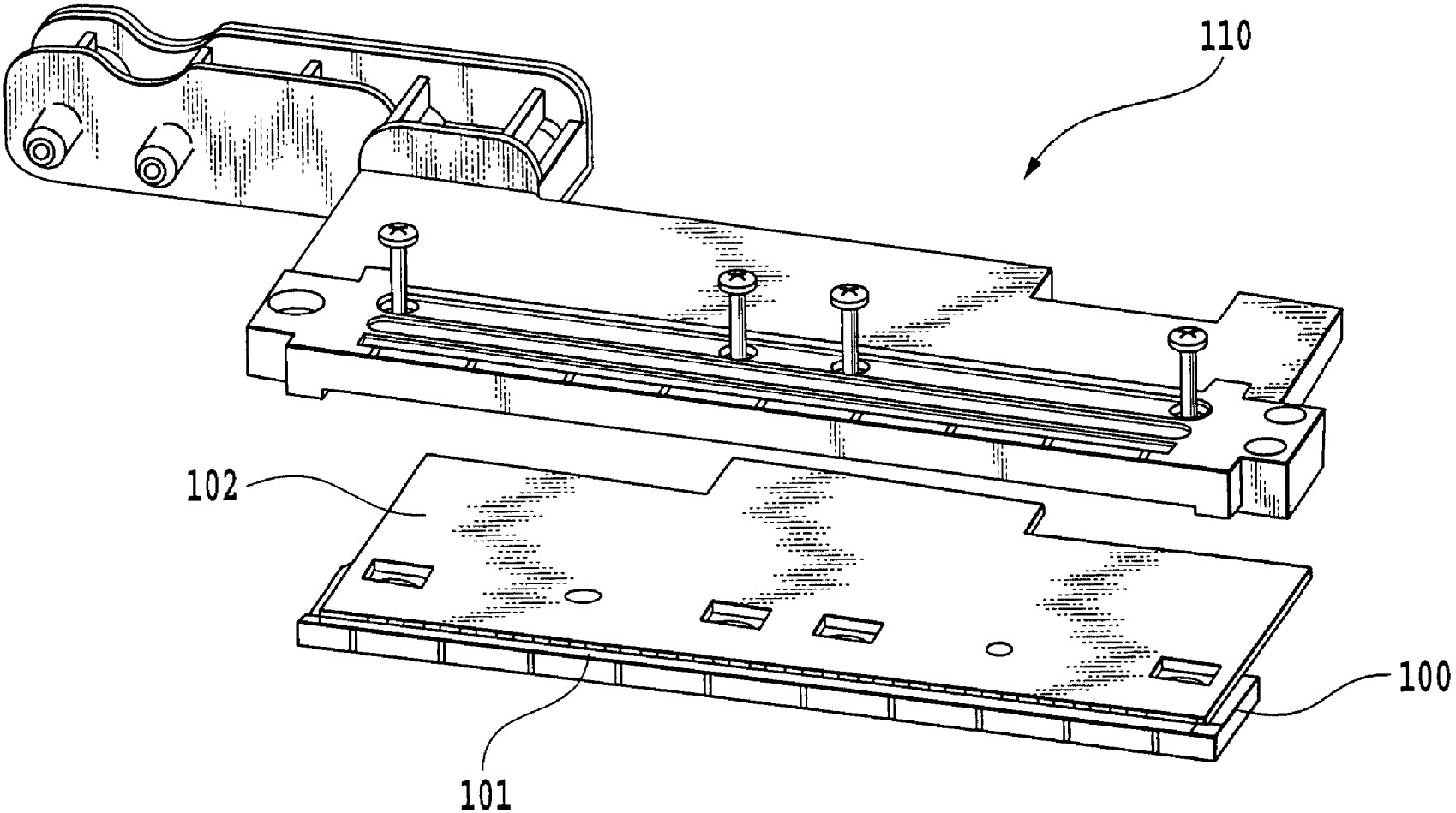
FIG. 2 is an exploded perspective view showing that the liquid ejecting head 110 is disassembled.

FIG. 2 is an exploded perspective view showing that the print head 110 is disassembled.

As shown in the figure, a heater board 101 is supported by a ceramic base plate 100. A wiring board 102 is disposed so that the heater board 101 is sandwiched between the wiring board 102 and the base plate 100. Heaters on the heater board 101 are electrically connected, by wire bonding, to the wiring board 102 in association with wires.

Figure 3:
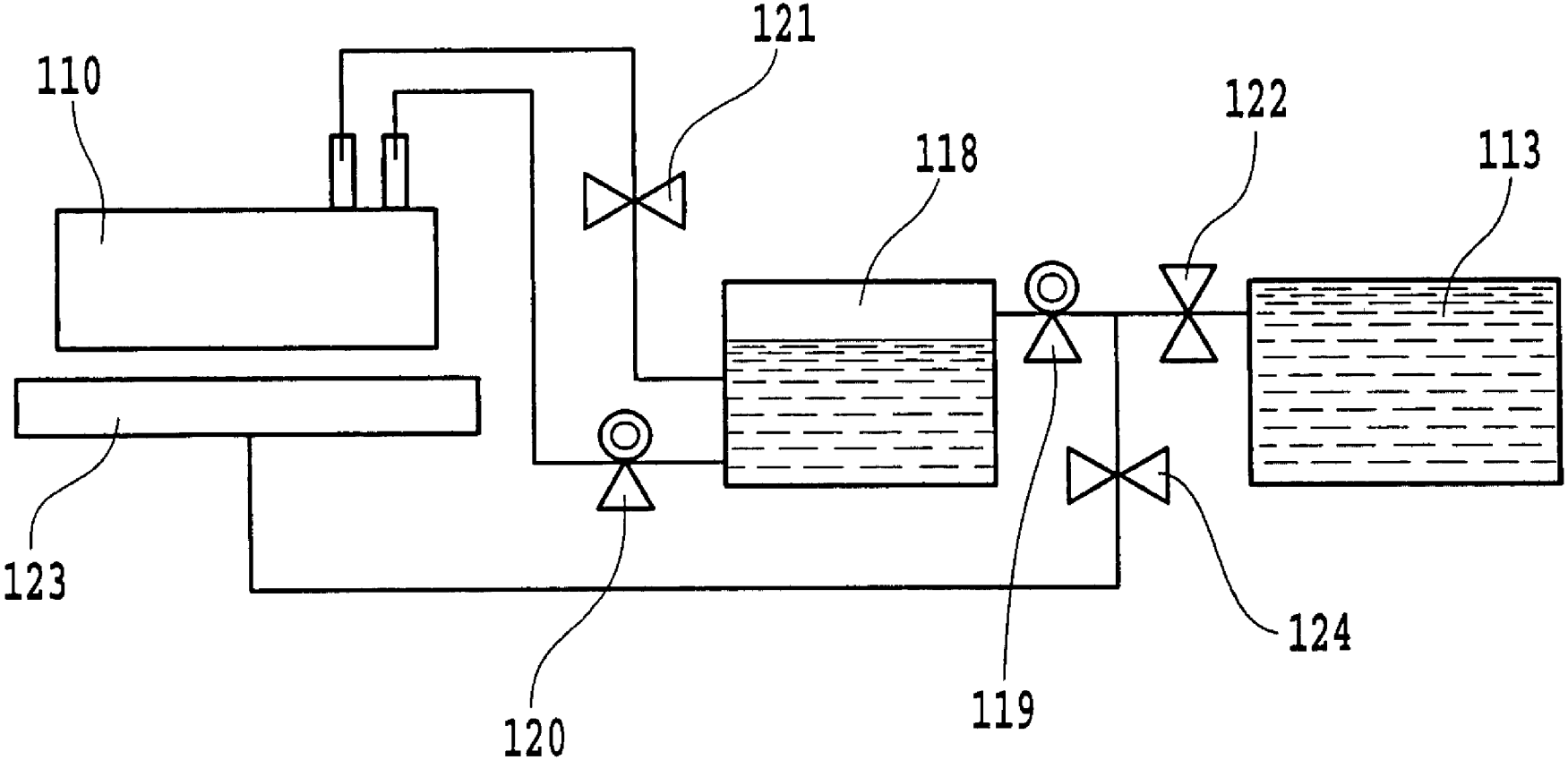
FIG. 3 is a diagram showing the configuration of a liquid supplying system in the ink ejecting device 111 that is an example of the present invention.

FIG. 3 is a diagram schematically showing the configuration of a liquid supply system in an ink ejecting device 111 according to an embodiment of the present invention.

The supply system is composed of the cartridge 113 that can be installed in and removed from the device, a sub-tank 118 that constitutes an orifice surface that is appropriate for the cartridge 113, a supply pump 119 that supplies ink from the cartridge 113 to the sub-tank 118, a pressurizing pump 120 that supplies the ink from the sub-tank 118 to the liquid ejecting head 110, and a recovery valve 121 that closes a channel through which the ink returns from the print head 110 while the liquid ejecting head 110 is being pressurized.

The supply pump 119 is also used for a recycle operation described below. A supply valve 122 is provided to select a path for the recycle operation.

The recycle operation of recycling ink ejected by the print head 110 is performed by a recovery 123 installed below an ejection surface of the liquid ejecting head, and a recycle valve 124 that operates to select an ink channel from the recovery 123 to the sub-tank 118.

Figure 4:
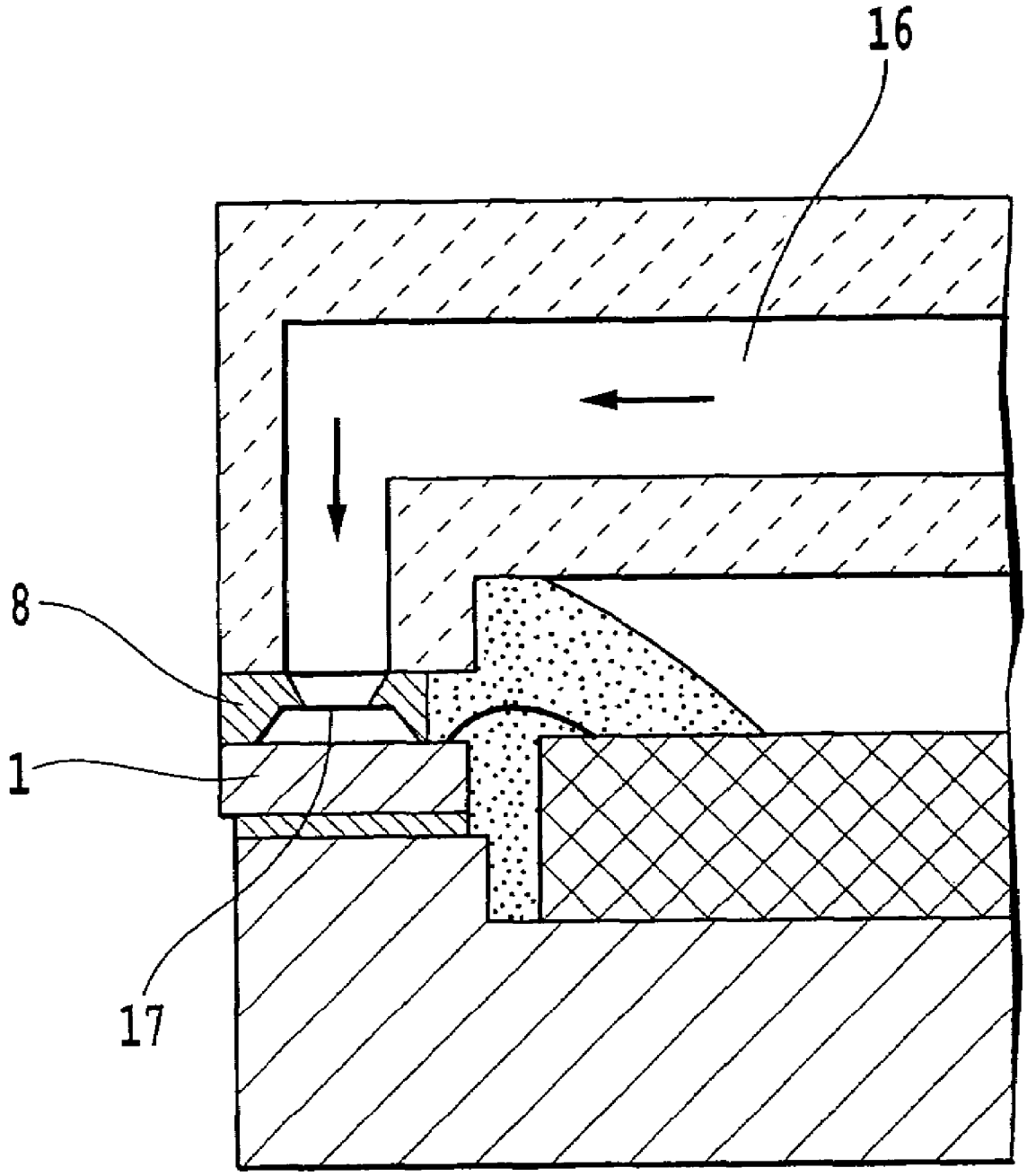
FIG. 4 is a sectional perspective view showing the vicinity of a head ejection nozzle according to the present invention.
Figure 5:
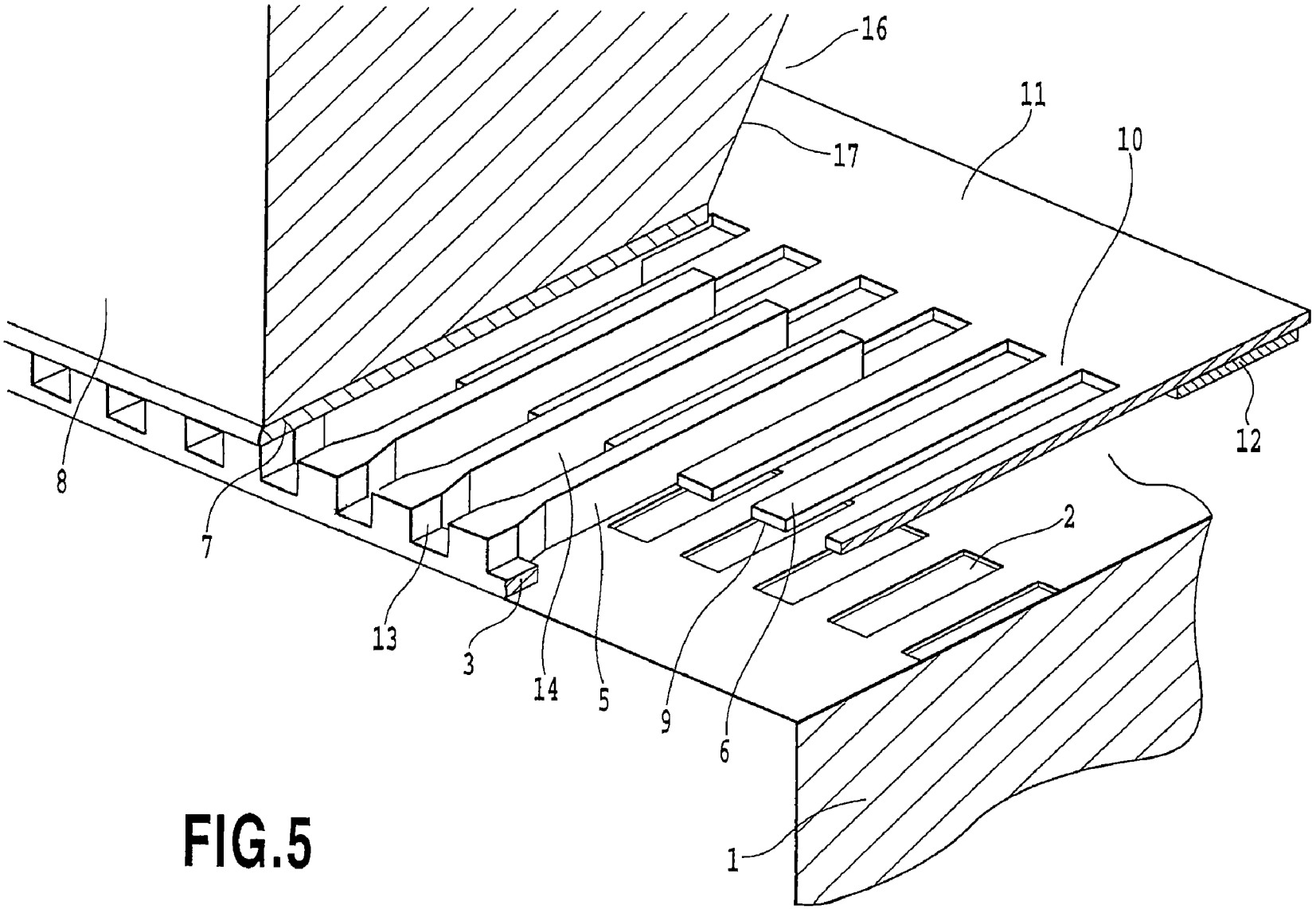
FIG. 5 is a sectional view showing the configuration of periphery of ejection openings in the liquid ejection head 110.

FIG. 4 is a sectional perspective view showing the vicinity of an ejection nozzle in the print head according to the present invention. FIG. 5 is a sectional view showing the configuration of periphery of ejection openings in the liquid ejecting head 110.

FIGS. 6A to 6D are sectional views of a side of the nozzle portion, showing how ink is ejected as the time elapses.

The mechanism of liquid ejection will be explained with reference to FIGS. 4, 5, and 6A to 6D.

A plurality of heaters 2 are arranged on the heater board 1 to heat and bubble a liquid. The heater 2 is composed of a resistor such as tantalum nitride and has a thickness of 0.01 to 0.5 μm and a sheet resistance of 10 to 300 ω per unit area.

The material of the heater may be different from tantalum nitride and the thickness and sheet resistance are not limited to the above ranges.

An electrode of aluminum or the like (not shown) is connected to one of the opposite connection ends of each heater 2 for electric application. A switching transistor (not shown) is connected to the other connection end to control the electric application to the heater 2.

The switching transistor is drivingly controlled by an IC consisting of a circuit of control gate elements and the like. The switching transistor is driven in a predetermined pattern in accordance with a signal from outside the head.

Ejection nozzles 14 are formed in association with the respective heaters and are in communication with the respective ejection openings 13. Each of the ejection nozzles 14 is shaped like a tube enclosed by the heater board 1, a nozzle wall 5, a nozzle reinforcing wall 3 of thickness 5 to 10 μm, and a nozzle roof plate 7 of thickness about 2 μm. In this case, the reinforcing wall 3 is extended from the ejection openings to a position as close to the heaters 2 as possible.

Movable valves 6 are provided, each of which has a free end 9 located closer to the ejection openings and a supporting point 10 located in a common liquid chamber. The supporting point 10 is attached to a valve supporting member 11 mounted on the heater board 1 via a valve seat 12.

The nozzle roof plate 7 is stuck to a rook plate 8 composed of Si or the like. The roof plate 8 comprises an ink supply opening 17 formed by anisotropic etching or the like and enables an external liquid to be introduced into a supply liquid chamber 16.

A liquid supplied from the common liquid chamber 16 to the ejection nozzle 14 is heated and bubbled by the heater 2, placed at a predetermined position in the ejection nozzle 14.

When the liquid in the ejection nozzle 14 starts to be bubbled, the movable valve 6 starts to be displaced to allow the flow of the liquid to be easily directed toward the ejection openings. A subsequent drop in the pressure in the resulting bubbles shrinks the bubbles to cut off ink droplets exiting the ejection openings. The liquid is thus ejected. This mechanism allows the liquid to be ejected from the ejection openings.

Figures 6A, 6B, 6C, 6D:
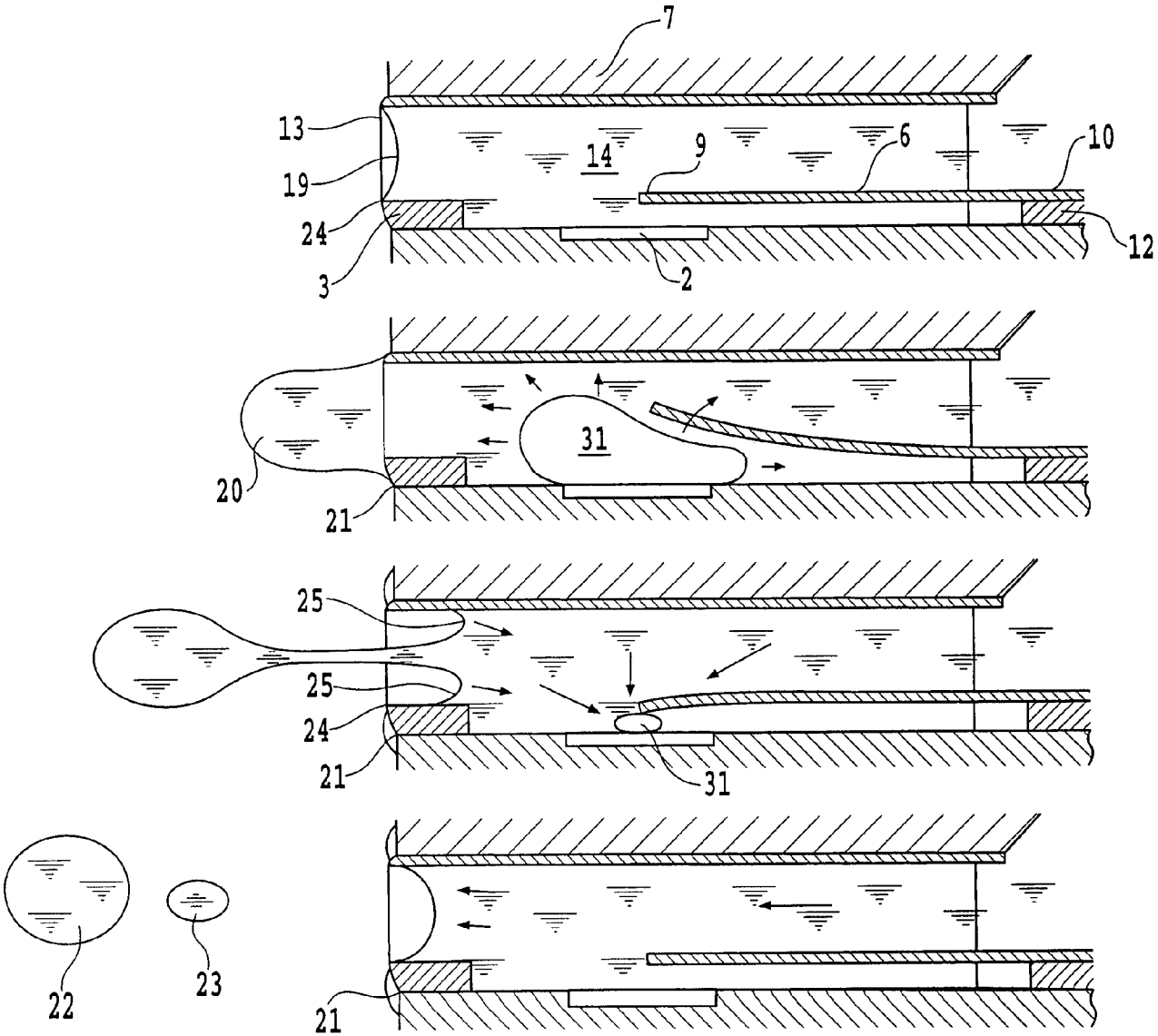
FIG. 6A is a sectional view of a side of the nozzle portion, showing how ink is ejected as the time elapses.
FIG. 6B is a sectional view of the side of the nozzle portion, showing how ink is ejected as the time elapses.
FIG. 6C is a sectional view of the side of the nozzle portion, showing how ink is ejected as the time elapses.
FIG. 6D is a sectional view of the side of the nozzle portion, showing how ink is ejected as the time elapses.

FIG. 6A shows a state in which electric energy or the like has not been applied to the heater 2, that is, the heater 2 has not generated any heat.

FIG. 6B shows a state in which electric energy is applied to the heater 2 to generate heat and thus bubbles. At this time, the movable valve 6 is displaced around the support point 10, located close to the ejection opening side of valve seat 12. This allows the propagation of the bubble pressure to be guided toward the ejection opening by means of pressure based on the bubble generation.

Figures 18A, 18B, 18C, 18D:
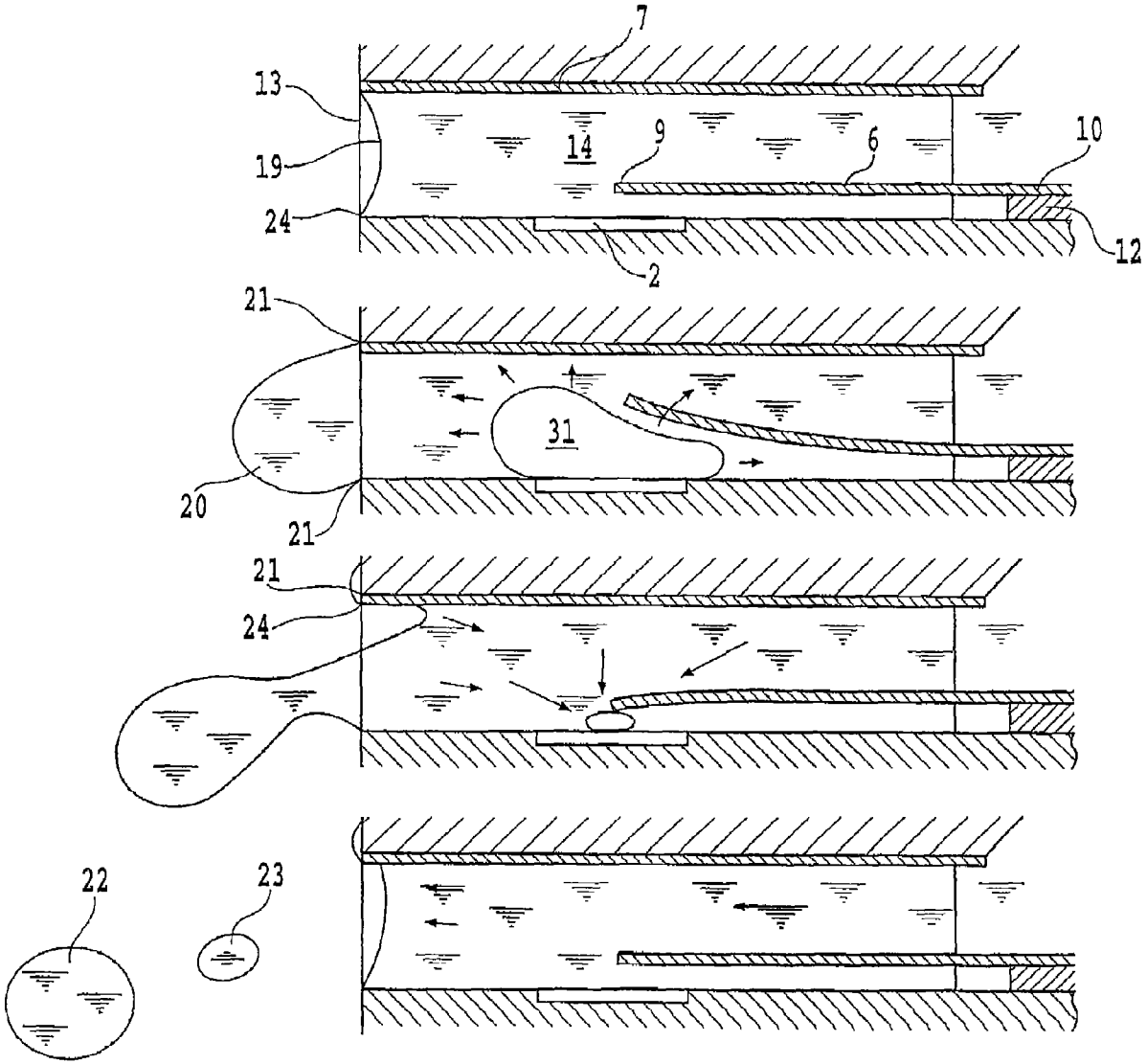
FIG.18A PRIOR ART
FIG.18B PRIOR ART
FIG.18C PRIOR ART
FIG.18D PRIOR ART
FIG. 18A is a sectional view of a side of a nozzle portion, showing how an ink trajectory is bent in a conventional example.
FIG. 18B is a sectional view of the side of the nozzle portion, showing how the ink trajectory is bent in the conventional example.
FIG. 18C is a sectional view of the side of the nozzle portion, showing how the ink trajectory is bent in the conventional example.
FIG. 18D is a sectional view of the side of the nozzle portion, showing how the ink trajectory is bent in the conventional example.

As a bubble 31 grows bigger, the liquid is pushed toward the ejection opening. The liquid is formed into an ejecting liquid column 20 at the ejection opening. At this time, the liquid spreads toward the periphery of the nozzle to form a horizontally dripping liquid 21 that spreads toward the nozzle periphery. In the prior art, the nozzle periphery is formed of different materials. The difference in wettability between these materials thus prevents the horizontally dripping liquid 21 from spreading uniformly. The ejecting liquid column 20 is thus bent as shown in FIG. 18B.

However, in the present embodiment, the ejection opening periphery is composed of the same material. The ejecting liquid column 20 can thus grow without being affected by the difference in wettability.

FIG. 6C shows the moment when the liquid is ejected after a bubble 31 has been generated by film boiling.

When the liquid is ejected, the decreasing intra-bubble pressure shrinks the bubble 31. The shrinking bubble 31 causes the surface 25 of root of the ejecting liquid column 20 to be drawn toward the common liquid chamber. The ejecting liquid column 20 is then cut off from the horizontally dripping liquid 21 spreading uniformly owing to an ejection opening edge 24.

When the ejecting liquid column 20 is cut off, if the ejection opening periphery is not raised, the horizontally dripping liquid 21 is not cut off from the root of the ejecting liquid column. Ejection is thus affected by the horizontally dripping liquid 21, thus making the ejecting direction unstable as shown in FIG. 18C.

Even if the nozzle periphery is raised, if the distance between the movable valve and the heater is at least half the distance between the heater and the roof plate, which is equal to the height of the liquid channel, energy resulting from the negative pressure of the shrinking bubble 31 is consumed to draw the movable valve 6 toward the heater. As a result, the surface 25 of ejecting liquid column root cannot be sufficiently drawn toward the common liquid chamber. This causes the horizontally dripping liquid 21 to be inappropriately cut off from the surface 25 of the ejecting liquid column root. The droplet ejecting direction is thus affected.

FIG. 6D is a diagram showing a state in which the bubble disappears and in which the ejecting liquid column 20 is cut off from the liquid and separated into a main droplet 22 and a sub-droplet 23 during ejection. Meniscus 19 retreats and returns in the direction of the arrow in the figure to supply ink to the interior of the nozzle.

As shown in FIG. 6D, the horizontally dripping liquid remains adhering to the ejection opening periphery even after ejection. In this state, ejection is carried out again. However, in the liquid ejecting head of the present embodiment, the resin is raised from the ejection opening portion. This prevents the horizontally dripping liquid adhering to the ejection opening periphery from contacting the ejected ink droplets during ejection. Consequently, the ejected ink droplets are not affected by the horizontally dripping liquid during ejection. Therefore, the ejected ink droplets can be ejected perpendicularly to the ejection opening surface.

FIGS. 7A, 8A, 9A, 10A, 11A, 12A, 13A, 14A, 15A, and 16A are front views of a process of manufacturing a liquid ejecting head. FIGS. 7B, 8B, 9B, 10B, 11B, 12B, 13B, 14B, 15B, and 16B are side views of the process of manufacturing a liquid ejecting head. Here, with reference to these figures, description will be given of the method for manufacturing a liquid ejecting head.

Figure 7B:
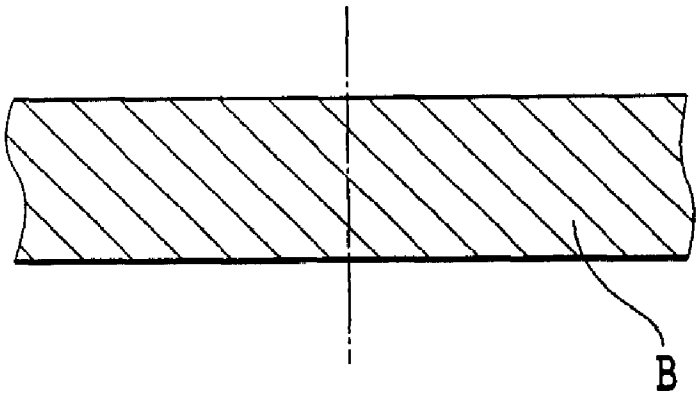
FIG. 7B is a side view illustrating the method for manufacturing a liquid ejecting head.
Figure 7A:
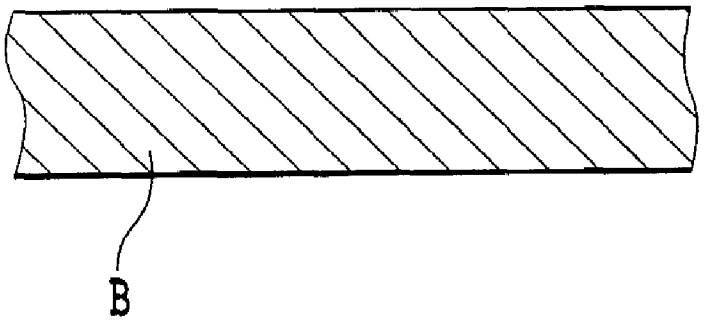
FIG. 7A is a front view illustrating a method for manufacturing a liquid ejecting head.
Figure 8B:
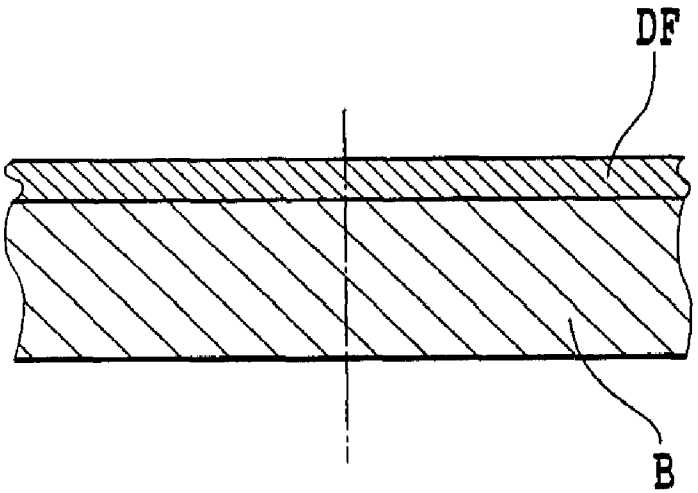
FIG. 8B is a side view illustrating the method for manufacturing a liquid ejecting head.
Figure 8A:
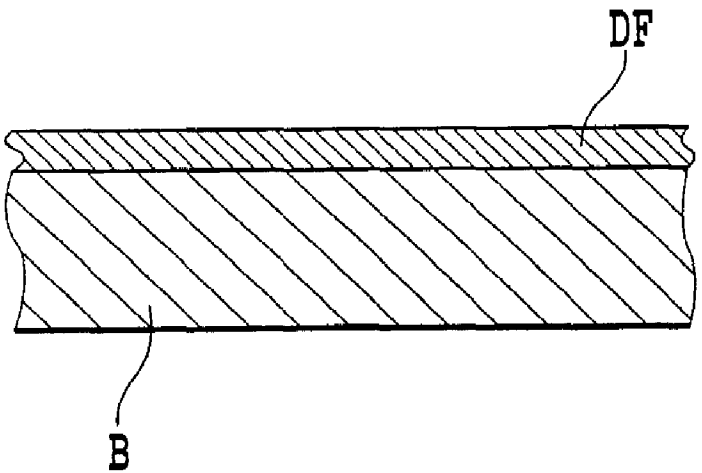
FIG. 8A is a front view illustrating the method for manufacturing a liquid ejecting head.

As shown in FIGS. 7A and 7B, the present embodiment uses a manufacturing apparatus similar to that used for a semiconductor manufacturing process to form heaters consisting of hafnium boride or tantalum nitride on an element substrate (silicon wafer) B. During the next step, the surface of the element substrate B is washed in order to improve the adhesion between the element substrate and a photosensitive resin film DF. The surface of the element substrate B is modified with ultraviolet rays-ozone or the like in order to further improve the adhesion. This is achieved by spin coating, for example, a silane coupling agent diluted to 1 wt % in ethyl alcohol, on the modified surface. Then, as shown in FIGS. 8A and 8B, an ultraviolet photosensitive resin film DF is laminated on the element substrate with its adhesion improved by surface washing. The alternate long and short dash line shows a cut surface during the final step. The cutting during the subsequent step makes ejection openings appear on the cut surface.

Figure 9B:
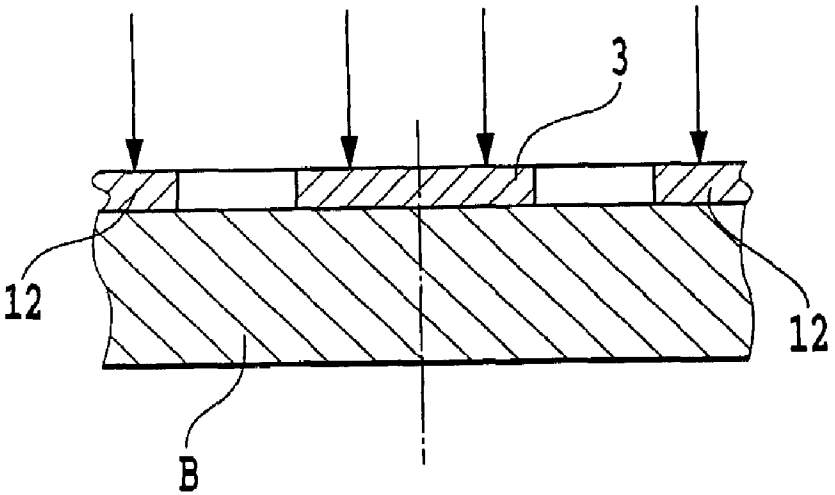
FIG. 9B is a side view illustrating the method for manufacturing a liquid ejecting head.
Figure 9A:
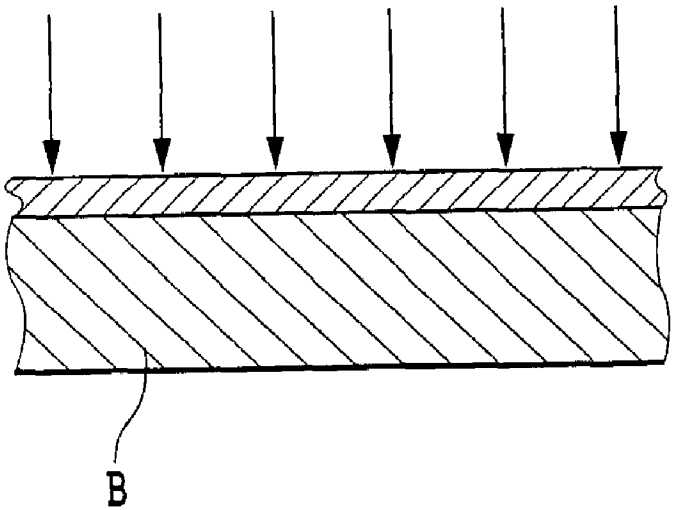
FIG. 9A is a front view illustrating the method for manufacturing a liquid ejecting head.

Then, as shown in FIGS. 9A and 9B, a part of the photosensitive resin film DF which is to remain as the valve seat 12 is irradiated with ultraviolet rays via a photo mask; the reinforcing wall 3 and movable valve 6 composed of an ultraviolet photosensitive resin film are bonded to the valve seat 12.

Figure 10B:
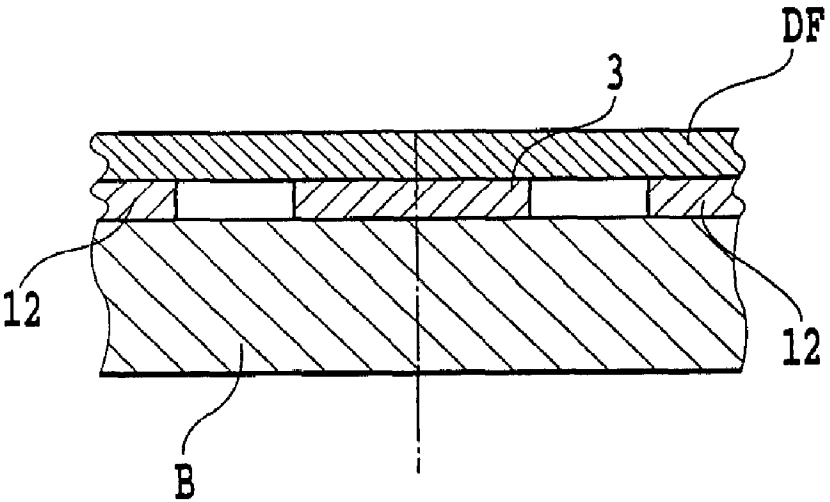
FIG. 10B is a side view illustrating the method for manufacturing a liquid ejecting head.
Figure 10A:
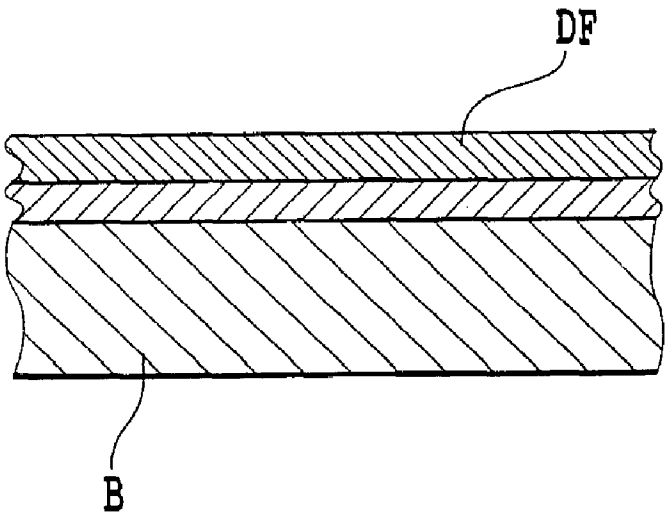
FIG. 10A is a front view illustrating the method for manufacturing a liquid ejecting head.

During the next step, as shown in FIGS. 10A and 10B, ultraviolet rays are applied and the ultraviolet photosensitive resin film DF is laminated on the remaining reinforcing wall 3.

Figure 11B:
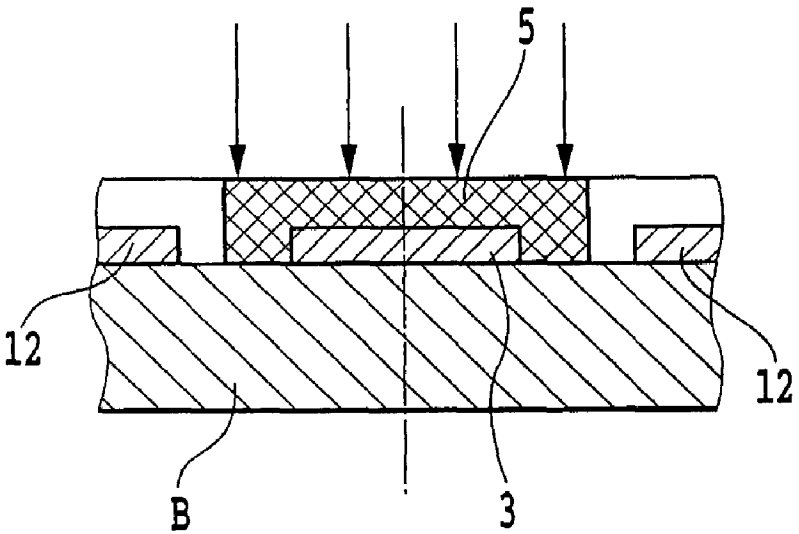
FIG. 11B is a side view illustrating the method for manufacturing a liquid ejecting head.
Figure 11A:
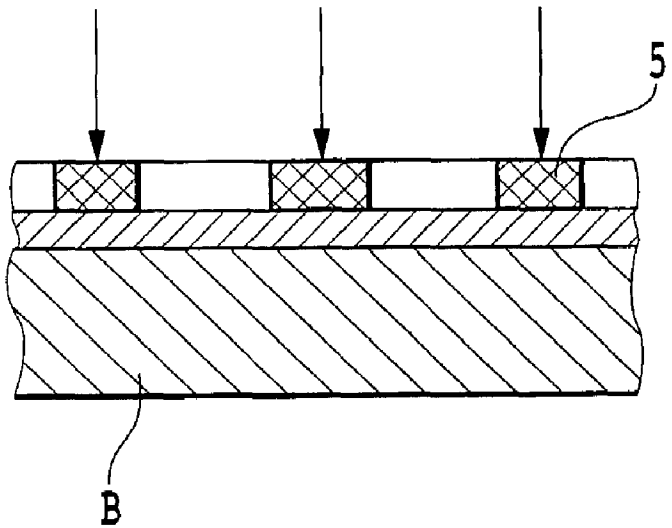
FIG. 11A is a front view illustrating the method for manufacturing a liquid ejecting head.

A photo mask is disposed on the laminated ultraviolet photosensitive resin film DF, and parts of the photo mask which are to remain as the nozzle walls 5 are irradiated with ultraviolet rays as shown in FIGS. 11A and 11B.

Figure 12B:
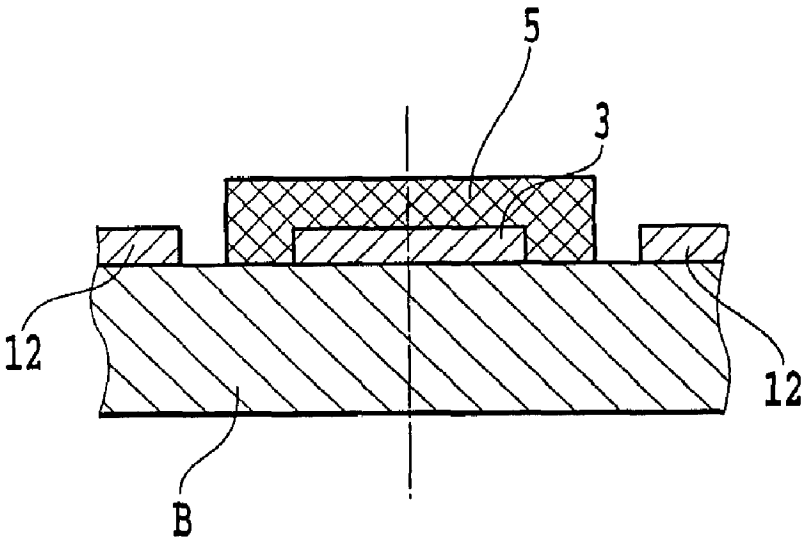
FIG. 12B is a side view illustrating the method for manufacturing a liquid ejecting head.
Figure 12A:
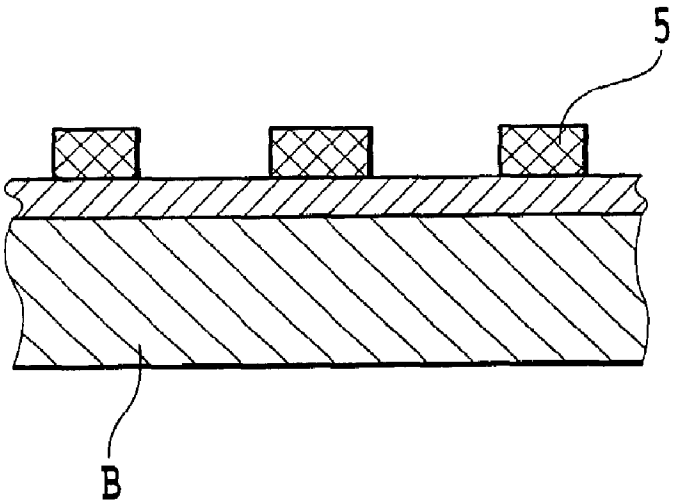
FIG. 12A is a front view illustrating the method for manufacturing a liquid ejecting head.
Figure 13B:
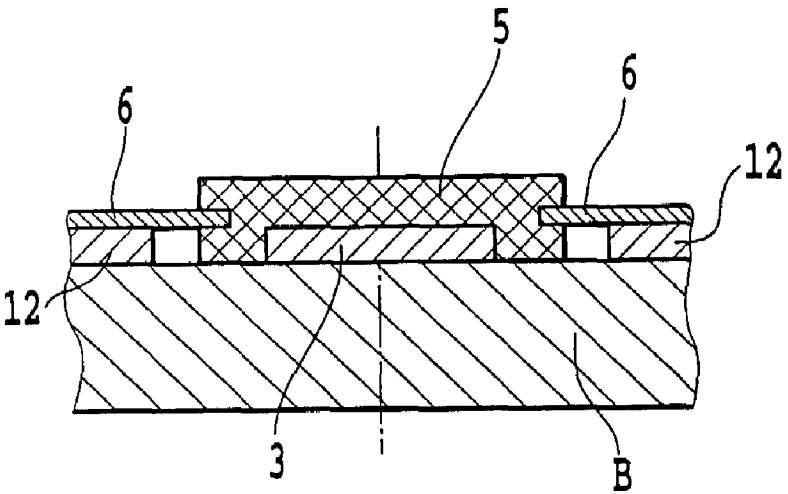
FIG. 13B is a side view illustrating the method for manufacturing a liquid ejecting head.
Figure 13A:
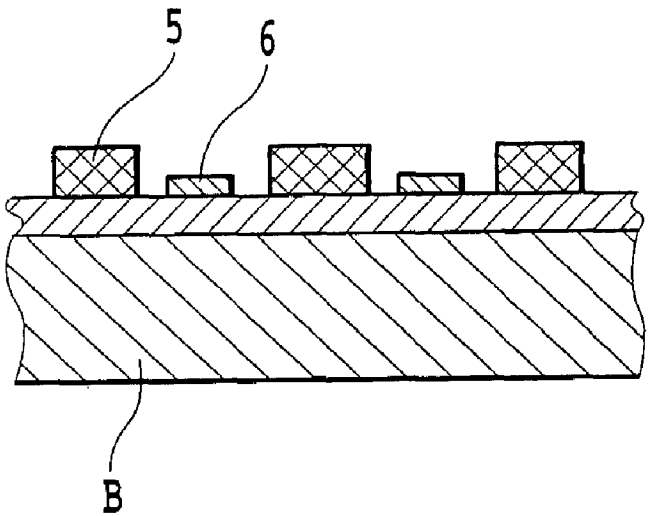
FIG. 13A is a front view illustrating the method for manufacturing a liquid ejecting head.

Then, as shown in FIGS. 12A and 12B, the ultraviolet photosensitive resin film DF is developed in a developer consisting of a mixture of xylene and butyl cellusolve acetate to melt unexposed parts. Exposed and hardened parts are formed into nozzle walls 5. After the nozzle walls 5 are formed, the movable valves 12 are fixed to the valve seats 12 with an adhesive or the like as shown in FIGS. 13A and 13B.

Figure 14B:
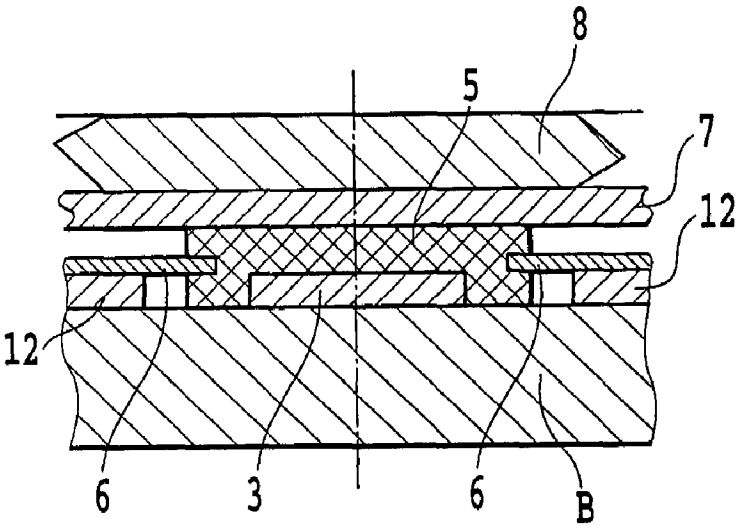
FIG. 14B is a side view illustrating the method for manufacturing a liquid ejecting head.
Figure 14A:
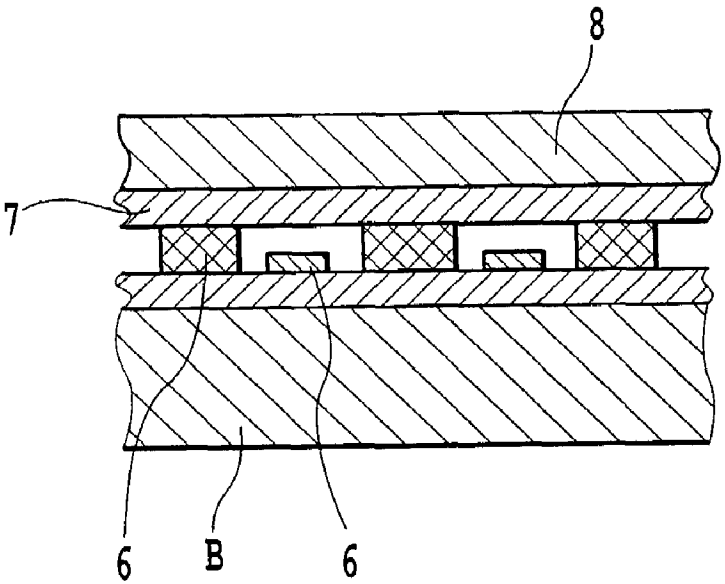
FIG. 14A is a front view illustrating the method for manufacturing a liquid ejecting head.

The roof plate 8 is subsequently welded to the nozzle wall 5 as shown in FIGS. 14A and 14B; the roof plate nozzle 7 made of a photosensitive resin film has been laminated to the roof plate 8.

During the next step, the thus manufactured structure is cut at an ejection opening butting surface to make the ejection openings appear. The cutting step will be described below.

Figure 15B:
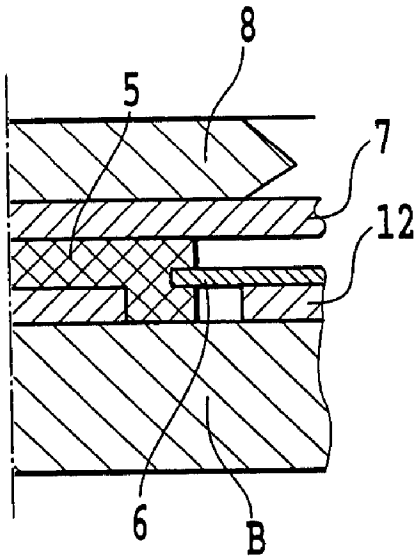
FIG. 15B is a side view illustrating the method for manufacturing a liquid ejecting head.
Figure 15A:
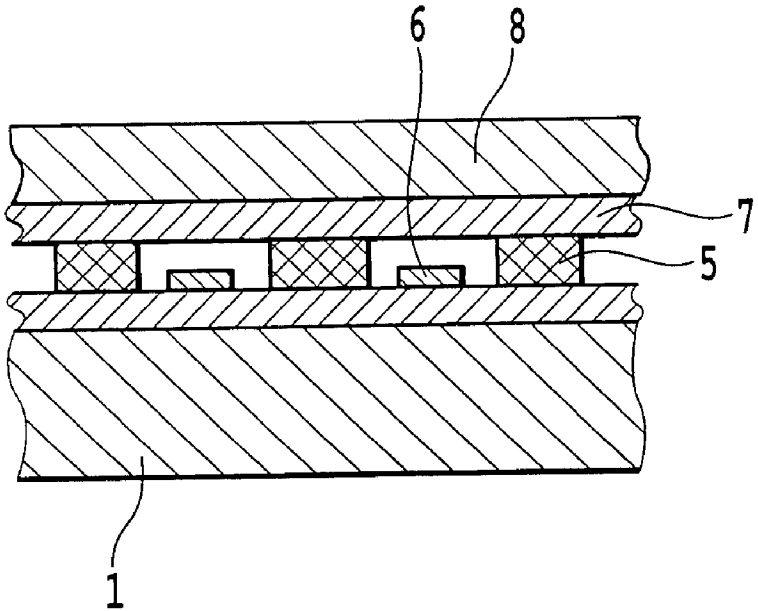
FIG. 15A is a front view illustrating the method for manufacturing a liquid ejecting head.

FIGS. 15A and 15B are sectional views schematically showing that the structure has been cut at the cut surface.

Figure 16B:
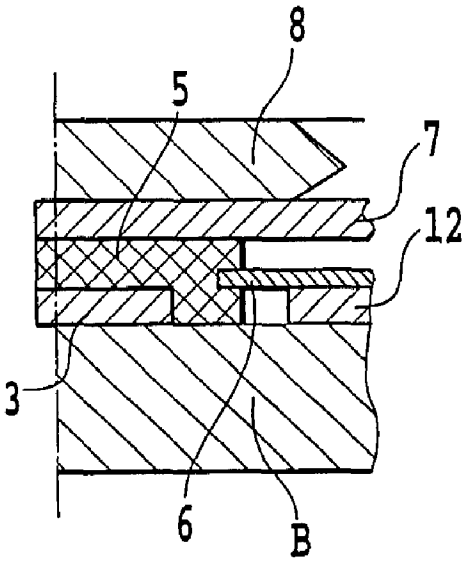
FIG. 16B is a side view illustrating the method for manufacturing a liquid ejecting head.
Figure 16A:
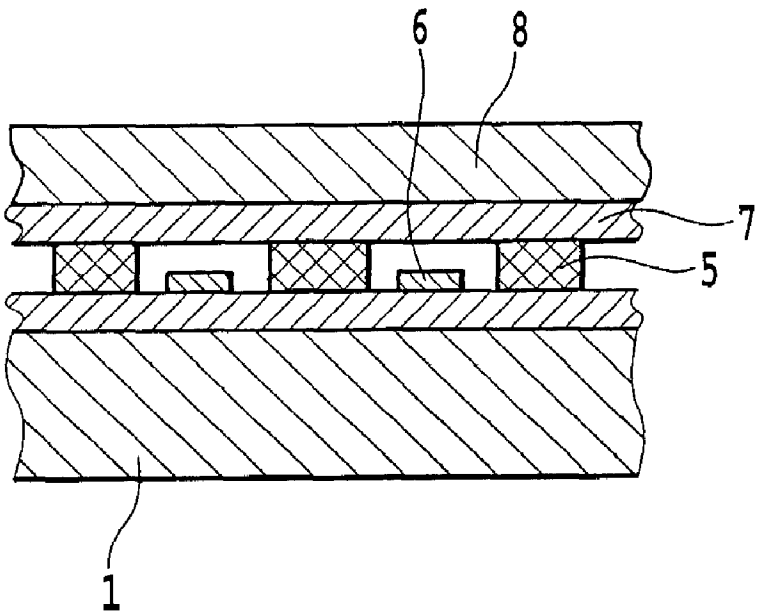
FIG. 16A is a front view illustrating the method for manufacturing a liquid ejecting head.
Figure 17:
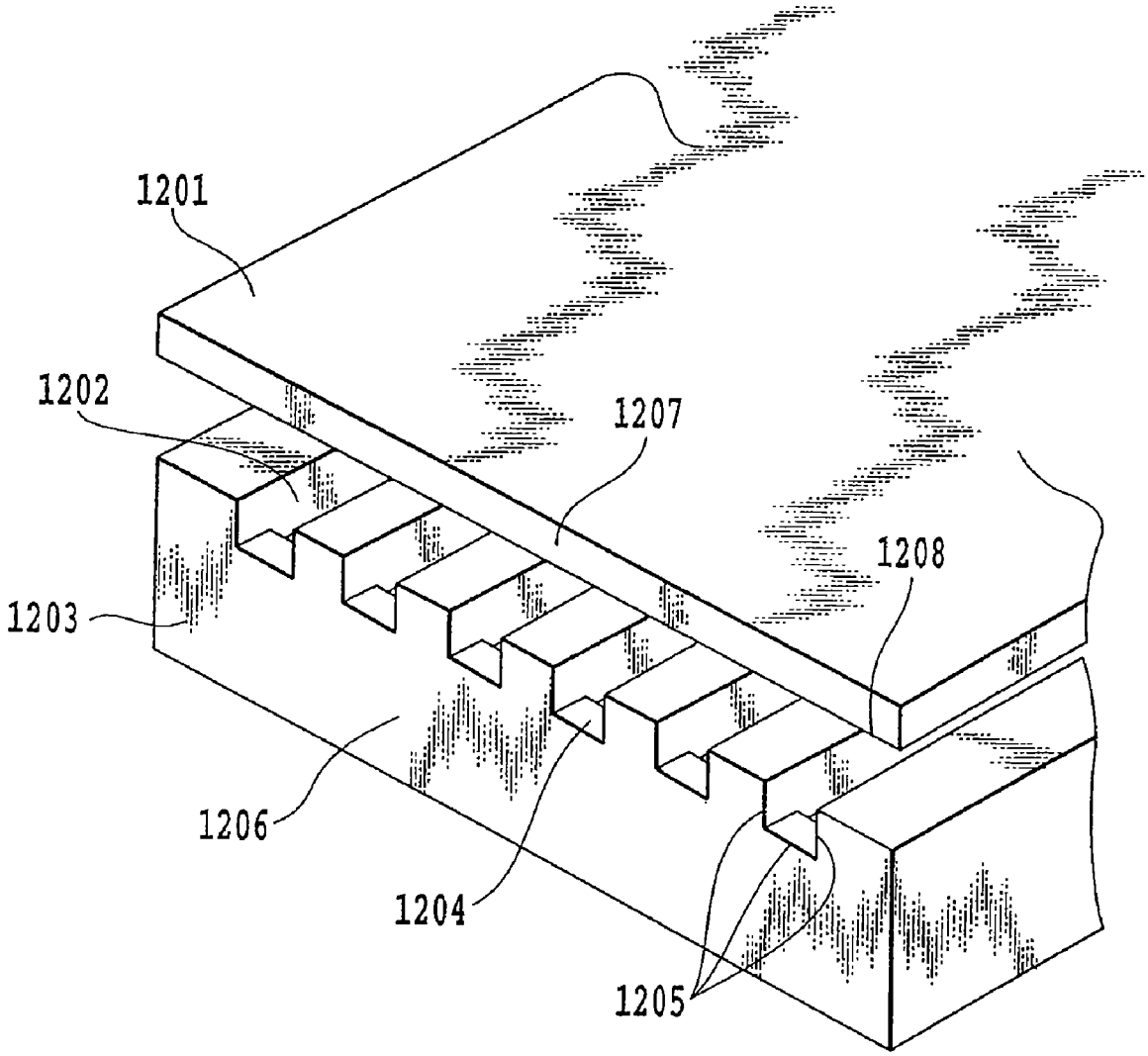
FIG.17 PRIOR ART
FIG. 17 is a perspective view schematically showing the configuration of a conventional ink jet print head.

The structure shown in FIGS. 14A and 14B is cut into two as shown in FIGS. 15A and 15B, using a dicing machine to which a diamond blade of thickness 0.05 mm is attached. Polishing is then carried out with a constant pressure exerted on the cut surface resulting from the separation in order to smooth the cut surface while raising the resin material in the ejection opening periphery. On this occasion, since the resin material forming the ejection opening periphery is more resilient than the element substrate B, a reference member for cutting, relieving the pressure involved in the polishing allows the resin material in the ejection opening periphery to rise from the cut surface as shown in FIG. 16B. The present embodiment raises the ejection opening periphery by about 0.2 to 2 μm.

To form ejection openings, the present embodiment cuts a structure with ejection openings butted against each other and polishes the cut surface. However, the present invention is not limited to this method. Alternative manufacture method makes a single cut structure and then polishes a surface with ejection openings.

The present embodiment uses the ultraviolet photosensitive resin film to form channel walls. However, the present invention is not limited to this. Any other material may be used provided that it is resilient.

The present embodiment uses the ultraviolet photosensitive resin film to form reinforcing walls. However, the present invention is not limited to this. Any other material may be used provided that it is resilient.

The present invention has been described in detail with respect to preferred embodiments, and it will now be apparent from the foregoing to those skilled in the art that changes and modifications may be made without departing from the invention in its broader aspects, and it is the intention, therefore that the appended claims cover all such changes and modifications.

This application claims priority from Japanese Patent Application No. 2005-259717 filed Sep. 7, 2005, which is incorporated hereinto by reference.

What is claimed is:

1. A print head having one or more ejection openings, liquid channels that are in communication with the ejection openings, and heaters provided in the liquid channels, the heaters bubbling a liquid to eject the liquid from the ejection openings, wherein a movable valve is provided in each of the channels that are in communication with the ejection openings, one end of each of the movable valves being displaceable in response to bubbling during ejection, and wherein a periphery of each of the ejection openings comprises an ejection opening peripheral member formed of the same material, and the ejection opening peripheral member is raised from an end surface of a substrate holding the ejection opening peripheral member which has the ejection openings.

2. The print head according to claim 1, wherein the ejection opening peripheral member is formed of a photosensitive epoxy resin.

3. The print head according to claim 1, wherein a distance between the movable valve and the heater is at most half a distance between the heater in the liquid channel and a surface located opposite the heater and constituting a part of the liquid channel.

* * * * *